US007902734B2

(12) United States Patent
Yamamoto et al.

(10) Patent No.: US 7,902,734 B2
(45) Date of Patent: Mar. 8, 2011

(54) ELECTRON EMISSION ELEMENT AND ELECTRON EMISSION ELEMENT FABRICATION METHOD

(75) Inventors: Yoshiyuki Yamamoto, Itami (JP); Natsuo Tatsumi, Itami (JP); Yoshiki Nishibayashi, Itami (JP); Takahiro Imai, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 786 days.

(21) Appl. No.: 11/883,323

(22) PCT Filed: Sep. 21, 2006

(86) PCT No.: PCT/JP2006/318755

§ 371 (c)(1), (2), (4) Date: Jul. 30, 2007

(87) PCT Pub. No.: WO2007/037170

PCT Pub. Date: Apr. 5, 2007

(65) Prior Publication Data

US 2008/0116446 A1 May 22, 2008

(30) Foreign Application Priority Data

Sep. 29, 2005 (JP) ..... 2005-284815

(51) Int. Cl.
*H01J 1/304* (2006.01)

(52) U.S. Cl. ..... 313/311; 313/346 R

(58) Field of Classification Search ..... 313/311, 313/346 R

See application file for complete search history.

(56) References Cited

U.S. PATENT DOCUMENTS

| | | | | |
|---|---|---|---|---|
| 5,728,435 | A | 3/1998 | Geis et al. | |
| 5,959,400 | A * | 9/1999 | Niigaki et al. | 313/495 |
| 6,132,278 | A * | 10/2000 | Kang et al. | 445/14 |
| 2002/0039870 | A1 | 4/2002 | Kaneko et al. | |
| 2006/0244352 | A1 * | 11/2006 | Tatsumi et al. | 313/311 |

FOREIGN PATENT DOCUMENTS

| | | |
|---|---|---|
| EP | 1 667 188 A1 | 6/2006 |
| JP | 2001-329252 | 11/2001 |
| JP | 2002-175756 | 6/2002 |
| JP | 2003-31109 | 1/2003 |
| JP | 2005-108637 | 4/2005 |
| JP | 2005-310724 | 11/2005 |

(Continued)

OTHER PUBLICATIONS

Translation of International Preliminary Report on Patentability and Written Opinion of the International Searching Authority, issued in corresponding International Patent Application No. PCT/JP2006/318755, dated on Apr. 10, 2008.

(Continued)

*Primary Examiner* — Evan Pert

(74) *Attorney, Agent, or Firm* — McDermott Will & Emery LLP

(57) ABSTRACT

An electron emitting device 2 comprises an electron emitting portion 6 made of diamond. At an electron emission current value of 10 μA or more, a deviation of the electron emission current value over one hour is within ±20% in the electron emitting device 2. The number of occurrence of step-like noise changing the electron emission current value stepwise is once or less per 10 minutes.

6 Claims, 8 Drawing Sheets

FOREIGN PATENT DOCUMENTS

| | | | |
|---|---|---|---|
| JP | 2006-219711 | | 8/2006 |
| WO | WO 93/15522 | | 8/1993 |
| WO | WO/2005/027172 | * | 3/2005 |
| WO | WO 2005/027172 A1 | | 3/2005 |

OTHER PUBLICATIONS

Geis, M.W., et al., "Diamond emitters fabrication and theory", JVST B, May/Jun. 1996, pp. 2060-2067, vol. 14 No. 3, American Vacuum Society.

Kang, W. P., et al., "Recent development of diamond microtip field emitter cathodes and devices", JVST B, May/Jun. 2001, pp. 936-941, vol. 19 No. 3, American Vacuum Society.

Hirano, T., et al., "A MOSFET-structure Si Tip for Stable Emission Current", IEDM, 1996, p. 309-312, IEEE.

Yamada, T., et al., "7a-ZD-5 Field emission mechanism of oxidized heavily phosphorus-doped homoepitaxial diamond", 2005, p. 633, The Japan Society of Applied Physics.

Takeuchi, D., "31p-Q-7 Photoelectron omission from diamond surfaces (I)", 2005, p. 696, The Japan Society of Applied Physics.

Nagao, M., et al., " Stability of Field Emission Current from Boron-Doped Diamond Thin Films Terminated with Hydrogen and Oxygen", Japan J. Appl. Phys. 1997, p. L1250-1258, vol. 36.

European Search Report issued in European Patent Application No. 06798197.7-2208, mailed Aug. 5, 2009.

Yamada, T., et al., "Field emission from heavily phosphorus-doped homoepitaxial diamond", Technical Digest of the 18th International Vacuum Nanoelectronics Conference, Jul. 2005, pp. 225-226, Oxford U.K.

* cited by examiner

ELECTRON EMISSION ELEMENT AND ELECTRON EMISSION ELEMENT FABRICATION METHOD

RELATED APPLICATIONS

This application is the U.S. National Phase under 35 U.S.C. §371 of International Application No. PCT/JP2006/318755, filed on Sep. 21, 2006, which in turn claims the benefit of Japanese Application No. 2005-284815, filed on Sep. 29, 2005, the disclosures of which Applications are incorporated by reference herein.

TECHNICAL FIELD

The present invention relates to an electron emitting device and a method of manufacturing the electron emitting device.

BACKGROUND ART

Recently, cold cathodes whish is used as an electron emitting device for emitting electrons are under development in addition to hot cathodes. Electron emitting devices, such as cold cathodes, have an electron emitting part made of molybdenum, carbon nanotube, or diamond, for example. In particular, electron emitting devices having electron emitting parts made of diamond are attractive because the electron affinity of diamond is negative Patent Document 1 discloses a pn-junction-type electron emitting device as an example of an electron emitting device having an electron emitting part made of diamond. Nonpatent Document 1 discloses an electron emitting device having an electron emitting part and a surface of a metal cathode therein is coated with a diamond film. Nonpatent Document 2 discloses an electron emitting device having a pointed electron emitting part.

Nonpatent Document 3 discloses an electron emitting device having an electron emitting part made of silicon.

Patent Document 1: International Publication No. 93/15522 Pamphlet

Nonpatent Document 1: Journal of Vacuum Science and Technology B14 (1996) 2060

Nonpatent Document 2: Journal of Vacuum Science and Technology B19 (2001) 936

Nonpatent Document 3: Tech. Dig. Int. Electron Devices Meet. (1996), A MOSFET-structure dSi Tip for Stable Emission Current

DISCLOSURE OF THE INVENTION

Problem to be Solved by the Invention

One of characteristics required for an electron emitting device is the stability of current value during the emission of electrons, i.e., the stability of electron emission value. For example, when the electron emitting device is used for electron beam exposure, uniform electron beams are needed for performing fine processings of the order of nanometers. For obtaining the uniformity of electron beams, the stability of electron current in the beams is a very important matter. Large fluctuations in the current value of electron beams are likely to cause excessive exposure or insufficient exposure, and thus the processes of electron beams with a large fluctuation in the current value cannot be used to obtain desirable forms.

When the emission current generated by the electron emitting device used for a microwave oscillator, for example, is unstable, loads will act on it. This may cause anomalous electrical discharges on the output port thereof.

Thus, there has recently been a strong demand for stabilizing the electron emission current value. However, the fluctuation of the electron emission current value is large in the electron emitting devices that are disclosed in Patent Document 1 and Nonpatent Documents 1 to 3, and is the cause of noises, such as flicker noise, spike-like noise, and step-like noise.

Here, the flicker noise means a noise whose value exceeds a predetermined threshold in the electron emission current value for ten seconds or more. The spike-like noise means a noise in which the electron emission current suddenly rises to exceed a predetermined threshold and suddenly returns to the former value. The step-like noise means a noise whose value exceeds a predetermined threshold in the electron emission current value and is kept for a short time of ten seconds or less.

For example, Nonpatent Document 2 discloses an electron emitting device having an electron emitting part made of p-type diamond doped with boron. When the electron emission current value is 4 μA in this electron emitting device, the deviation of the electron emission current value over 30 minutes is ±15%, while the number of step-like noises observed therein is 4.7 times per 10 minutes. When the electron emission current value is 1 μA in the electron emitting device disclosed in Nonpatent Document 3, the deviation of the electron emission current value over one hour is ±50%. Thus, the electron emitting devices of Patent Document 1 and Nonpatent Documents 1 to 3 fail to yield stable electron emission currents.

Therefore, it is an object of the present invention to provide an electron emitting device and a method of manufacturing an electron emitting device which yield a stable electron emission current.

Means for Solving Problem

For solving the problem mentioned above, the electron emitting device in accordance with a first aspect of the present invention comprises an electron emitting portion made of diamond; wherein, at an electron emission current value of 10 μA or more, a deviation of the electron emission current value over one hour is within ±20%; and wherein the number of occurrence of step-like noise changing the electron emission current value stepwise is once or less per 10 minutes. Here, "step-like noise" means a noise whose electron emission current value is changed to exceed a predetermined threshold and whose duration is a short time of ten seconds or less in which thus changed electron emission current value is kept.

The electron emitting device in accordance with a second aspect of the present invention comprises an electron emitting portion made of diamond; wherein, at an electron emission current value of 10 μA or more, a deviation of the electron emission current value over one hour is within ±1%; and wherein the number of occurrence of step-like noise in which the electron emission current value is changed stepwise is one or less per one hour.

Since the deviation of electron emission current value are suppressed and the number of occurrence of step-like noise is decreased, stable electron emission current values can be obtained in the electron emitting devices in accordance with the first and second aspects of the present invention. A more stable electron emission current value can be obtained in the electron emitting device in accordance with the second aspect of the present invention in particular.

Preferably, n-type diamond can be used for the diamond in the above is, and the surface of the electron emitting portion can be oxygen-terminated.

The adsorption of molecules on a surface of the electron emitting portion may cause noises, such as step-like noise and spike-like noise. However, the oxygen-terminated surface of the electron emitting portion prevents the adsorption of molecules thereon, thereby suppressing the occurrence of noises, such as, step-like noise and spike-like noise, thereby yielding a stable electron emission current. The electron emitting portion made of n-type diamond can improve the electron emission current value as compared to the electron emitting portion made of p-type diamond.

The method of manufacturing an electron emitting device in accordance with the present invention includes an oxygen termination step of oxygen-terminating a surface of an electron emitting portion made of n-type diamond.

In the method of manufacturing an electron emitting device in accordance with the present invention, the oxygen termination of the surface of an electron emitting portion can restrain the adsorption of molecules on this surface. Therefore, the electron emitting device manufactured by the method of manufacturing an electron emitting device in accordance with the present invention can suppress the occurrence of noises, such as, step-like noise and spike-like noise, thereby yielding a stable electron emission current value. The electron emitting portion made of n-type diamond can improve the electron emission current value as compared to the electron emitting portion made of p-type diamond.

Preferably, the electron emitting portion can be heated in an oxygen atmosphere in the oxygen termination step.

In this case, gas molecules (e.g., oxygen molecules) the vapor pressure of which is high come into contact with the surface of the electron emitting portion. Thus, molecules exhibiting a low vapor pressure are hard to remain on the surface of the electron emitting portion. Accordingly, the surface state of the electron emitting portion can be prevented from changing because of residual substances during the period when the resulting electron emitting device emits electrons. Consequently, stable electron emission is maintained.

Preferably, the electron emitting portion is heated in a liquid containing at least one of sulfuric acid and nitric acid in the oxygen termination step.

In this case, since the oxygen termination step makes the surface of the electron emitting portion hydrophobic, water molecules are hard to be adsorbed on a surface of the electron emitting portion even when the surface is washed with water, for example. This can keep the surface state of the electron emitting portion from changing because of residual substances during the period when the resulting electron emitting device emits electrons. Consequently, electrons can continuously be emitted in a stable manner.

Preferably, the method of manufacturing an electron emitting device further comprises a heating step of heating the electron emitting portion in a vacuum atmosphere after the oxygen termination step. This step can desorb the molecules (e.g., water molecules) adsorbed on the surface of the electron emitting portion.

Preferably, in the heating step, the electron emitting portion is heated for one hour or more at a temperature of 200° C. or less in a vacuum of $1\times10^{-3}$ Pa or less. This can efficiently desorb the adsorbed molecules.

Preferably, in the heating step, the electron emitting portion is heated for one hour or more at a temperature of 400° C. or less in a vacuum of $1\times10^{-6}$ Pa or less. This can further efficiently desorb the adsorbed molecules.

Preferably, the method of manufacturing an electron emitting device in accordance with the present invention further comprises an electron emission step of emitting an electron from the electron emitting portion in a vacuum after the oxygen termination step. This can desorb adsorbed molecules which are hard to be desorbed by the heating.

Preferably, in the electron emission step, electrons are emitted from the electron emitting portion for five hours or more in a vacuum of $1\times10^{-3}$ Pa or less. This can efficiently desorb adsorbed molecules which are hard to be desorbed by the heating.

EFFECT OF THE INVENTION

The present invention provides an electron emitting device and a method of manufacturing an electron emitting device which produces a stable electron emission current.

EXPLANATIONS OF NUMERALS

2, 22, 32 . . . electron emitting device; 6 . . . electron emitting portion; 6*a* . . . surface of the electron emitting portion; 120 . . . electron emitting layer (electron emitting portion); 120*a* . . . surface of the electron emitting layer (surface of the electron emitting portion).

BEST MODES FOR CARRYING OUT THE INVENTION

In the following, embodiments of the present invention will be explained in detail with reference to the accompanying drawings. In the explanation of the drawings, when possible, parts identical to each other will be referred to with reference symbols identical to each other.

First Embodiment

Figure 1:
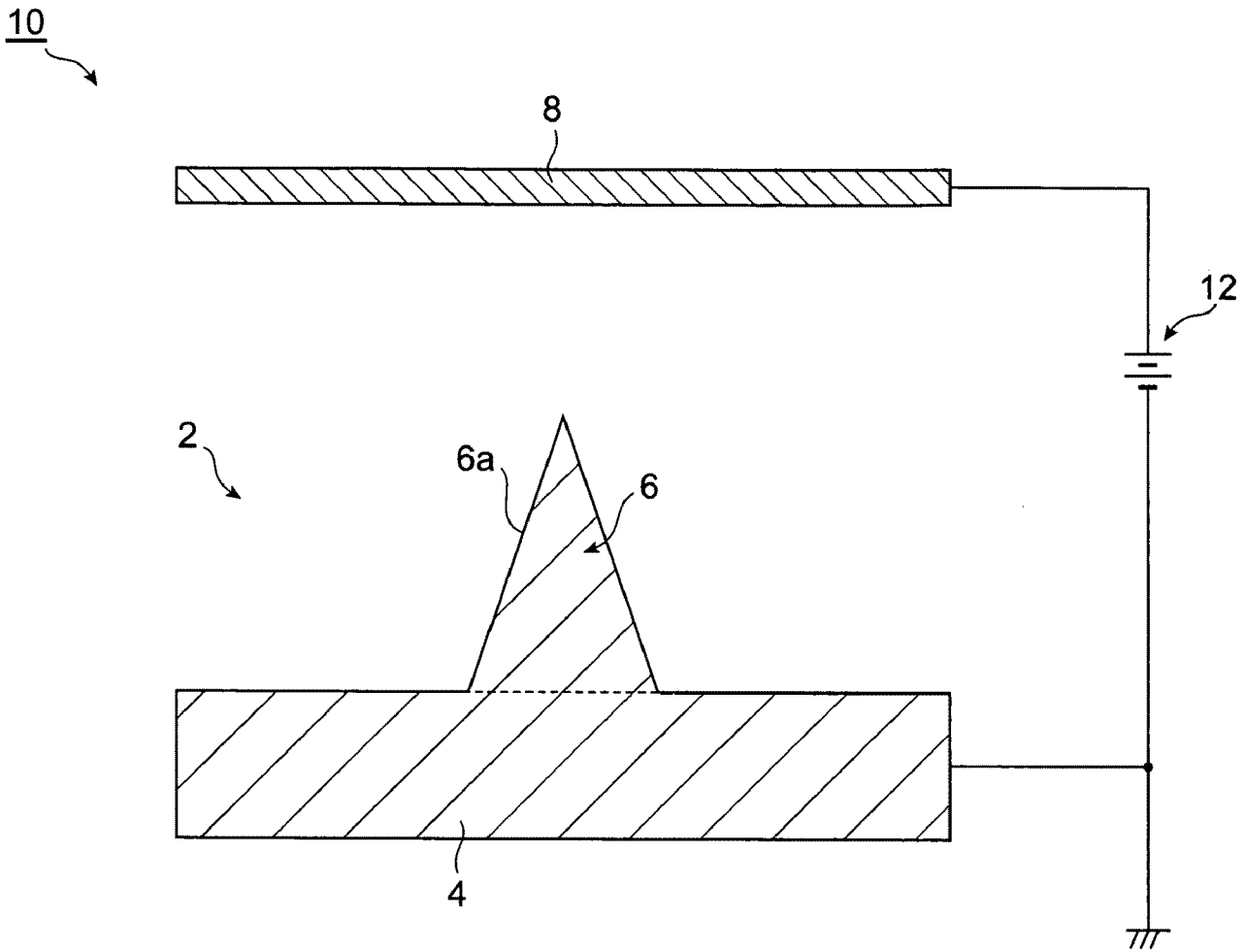
FIG. 1 is a sectional view schematically showing an electron source including an electron emitting device in accordance with a first embodiment.

FIG. 1 is a sectional view schematically showing an electron source equipped with an electron emitting device in accordance with the first embodiment. The electron source 10 shown in FIG. 1 comprises an electron emitting device 2, and an anode (anode electrode) 8 provided so as to oppose the electron emitting device 2. The electron emitting device 2 and anode 8 are placed in a vacuum chamber. The electron source 10 cane be widely used in apparatuses, such as those of high-frequency amplification, microwave oscillation, light-emitting devices, and electron beam exposure, for example.

The electron emitting device 2 includes an electron emitting portion 6 made of diamond, such as n-type diamond, for example. The electron emitting portion 6 is preferably constituted by one or more projections, and preferably each has a pointed shape, such as, conical or pyramidal form. The electron emitting portion 6 is provided on a substrate 4 made of diamond, for example. Preferably, a surface 6*a* of the electron emitting portion 6 is oxygen-terminated.

N-type diamond is formed by doping nondoped diamond free of impurities with at least one species of the following elements: nitrogen, phosphorus, sulfur, and lithium, or by doping it with boron as an impurity together with any of the elements. It is preferred in particular that phosphorus be used as an impurity.

A power supply 12 is connected between the anode 8 and electron emitting device 2 acting as a cathode, and is provided for applying a positive voltage to an anode 8 with reference to the electron emitting device 12. When the power supply 12 applies a predetermined voltage to the anode 8, an electric field is generated between the electron emitting device 2 and anode 8, and the electron emitting portion 6 emits electrons toward the anode 8.

When the electron emission current value is 10 μA or more in the electron emitting device 2, the deviation of the electron emission current value over one hour is within ±20%. The number of occurrence of step-like noise in which the electron emission current value is changed stepwise is once or less per 10 minutes. Since the deviation of electron emission current value is suppressed and the number of occurrence of step-like noise are decreased, the electron emitting device 2 can is provided with the stable emission of electron current.

When this electron emitting device 2 is used, for example, for electron beam exposure, it takes about 10 minutes to expose a device area of one square millimeter ($mm^2$) with a dose of about 30 $\mu C/cm^2$. Using the electron emitting device 2 makes it possible to suppress excessive exposure and insufficient exposure, whereby this electron beam exposure permits the processing of the exposed articles into desirable forms. Also, the above-mentioned electron emitting device 2 can favorably be used in apparatuses, such as, light-emitting devices which are less sensitive to the deviation of the electron emission current value.

More preferably, when the electron emission current value is 10 μA or more, the deviation of the electron emission current value over one hour is within ±1%, and the number of occurrence of step-like noise in which the electron emission current value is changed stepwise is once or less per 1 hour. Since the deviation of electron emission current value is suppressed and the number of occurrence of step-like noise is increased, a more stable electron emission current value can be provided with the electron emitting device 2. When this electron emitting device 2 is used for, for example, electron beam exposure, the reliability in the electron beam drawing can be improved by use of constant electron beams.

Noises, such as step-like noise and spike-like noise, may be caused when molecules in a reduced-pressure atmosphere are adsorbed on the surface 6*a* of the electron emitting portion 6. When the electron emitting portion 6 is made of n-type diamond and the surface 6*a* of the electron emitting portion 6 is oxygen-terminated, then the adsorption of molecules on the oxygen-terminated surface is harder than that of the hydrogen-terminated surface 6*a*. This oxygen-termination suppresses noises, such as, step-like noise and spike-like noise, thereby yielding a stable electron emission current.

From the viewpoint of the effective suppression of the molecule adsorption, the oxygen coverage ratio of the surface 6*a* of the electron emitting portion 6 is preferably at least 5%, more preferably 10 to 20%.

Figure 2:
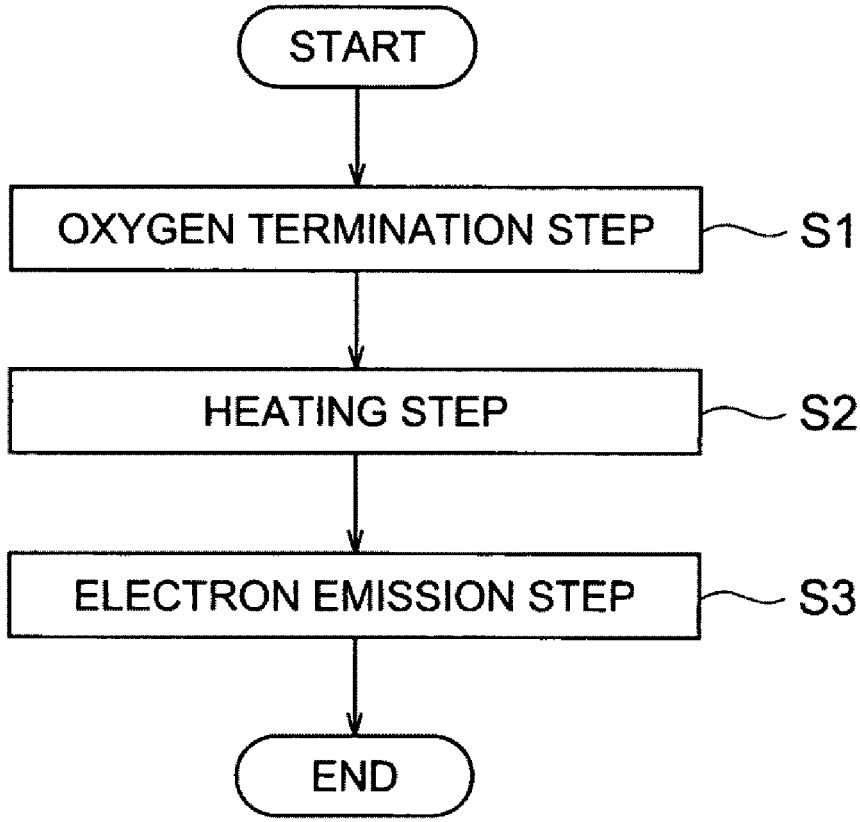
FIG. 2 is a flowchart schematically showing a procedure of a method of manufacturing an electron emitting device in accordance with the first embodiment.

FIG. 2 is a flowchart schematically showing a procedure of a method of manufacturing an electron emitting device in accordance with this embodiment. In the following, a method of manufacturing the electron emitting device 2 in accordance with this embodiment will be explained as an example of the method of manufacturing an electron emitting device. In this method, first, the surface of an electron emitting portion made of n-type diamond is oxygen-terminated (oxygen termination step "S1"). After the oxygen termination step "S1," the electron emitting portion is heated in a vacuum atmosphere (heating step "S2"). This heating permits the desorption of the molecules (e.g., water molecules) adsorbed on the surface 6*a* of the electron emitting portion 6. After the heating step "S2," the electron emitting portion is caused to emit electrons in a vacuum atmosphere (electron emission step "S3"). This emission permits the desorption of molecules which are hard to be desorbed by the heating. At least one of the heating step "S2" and electron emission step "S3" may be omitted. The heating step "S2" and electron emission step "S3" may be performed simultaneously as well.

Preparation Step

In a preparation step, an electron emitting device is prepared as in the following example. First, a natural or synthetic diamond substrate is prepared. The synthetic diamond substrate is favorably manufactured by using high-pressure high-temperature synthesizing method or vapor-phase synthesizing method. Subsequently, an n-type diamond layer doped with an n-type impurity, such as phosphorus, is epitaxially grown on the diamond substrate. Instead of the diamond substrate, a monocrystalline or polycrystalline n-type diamond layer may be formed on a substrate made of material, such as silicon, molybdenum or platinum.

A vapor phase synthesizing method, such as microwave plasma CVD, for example, can be used therefor, but the method of forming the n-type diamond layer is not limited thereto. In this example, it is preferable to mix the raw material gas with phosphine ($PH_3$), tertiary butylphosphine, or the like, for example. The n-type diamond layer can also be formed using ion implantation.

Next, a mask layer is formed on the n-type diamond layer. A photoresist is patterned into one or more dots, for example, to form the mask layer by using photolithography method. Here, it is preferable to form the mask layer by dry-etching using the photoresist mask. A mask layer made of Al, SiON, $SiO_2$, amorphous silicon, or the like may be used as well.

Next, the n-type diamond layer is dry-etched by a reactive ion etching (RIE) method using the mask layer. This etching forms one or more projections made of n-type diamond on the diamond substrate. In accordance with the above, the electron emitting device having the electron emitting portion provided on the substrate is prepared.

Oxygen Termination Step

In the oxygen termination step "S1," the electron emitting portion is heated in an oxygen atmosphere, such as air, for example, preferably at a temperature of 300° C. or higher. In this heating, gas molecules (e.g., oxygen molecules) the vapor pressure of which is high come into contact with the surface of the electron emitting portion in the oxygen termination step "S1." Thus, substances hardly remain on the surface of the electron emitting portion. This can prevent the change of the surface of the electron emitting portion because of residual substances thereon when the resulting electron emitting device is used to emit electrons. Therefore, electrons can continuously be emitted in a stable manner.

The electron emitting portion may be heated in a liquid containing at least one of sulfuric acid and nitric acid. Preferably, the heating temperature is equal to or more than 100° C. This heating in the oxygen termination step "S1" makes the surface of the electron emitting portion hydrophobic. Thus, water molecules are hard to be adsorbed on the hydrophobic surface of the electron emitting portion even when the surface is washed with water, for example. This hydrophobic surface can prevent changes of the surface state of the electron emitting portion because of adsorption of water molecules when the resulting electron emitting device emits electrons. Therefore, the continuous emission of electrons can be kept stable.

Heating Step

In the heating step "S2," the electron emitting portion is heated for one hour or more at a temperature of at least 100° C. but not higher than 200° C. in a vacuum atmosphere of $1\times10^{-3}$ Pa or less. This heating can efficiently desorb the adsorbed molecules. It is preferable in particular that the electron emitting portion be heated for one hour or more at a temperature of at least 100° C. but not higher than 400° C. in a vacuum atmosphere of $1\times10^{-6}$ Pa or less. This can further efficiently desorb the adsorbed molecules.

Electron Emission Step

Preferably, in the electron emission step "S3," the electron emitting portion keeps emitting electrons for five hours or more in a vacuum atmosphere of $1\times10^{-3}$ Pa or less (that is, aging). This can efficiently desorb adsorbed molecules which have not been desorbed by heating yet. The electron emission step "S3" may be performed during the heating step "S2."

The method of manufacturing an electron emitting device in accordance with this embodiment makes it possible to prevent the adsorption of molecules on the surface by oxygen-terminating the surface of the electron emitting portion. Therefore, the electron emitting device 2 manufactured by use of this method suppresses noises, such as, step-like noise and spike-like noise, thereby providing a stable electron emission current.

Second Embodiment

Figure 3:
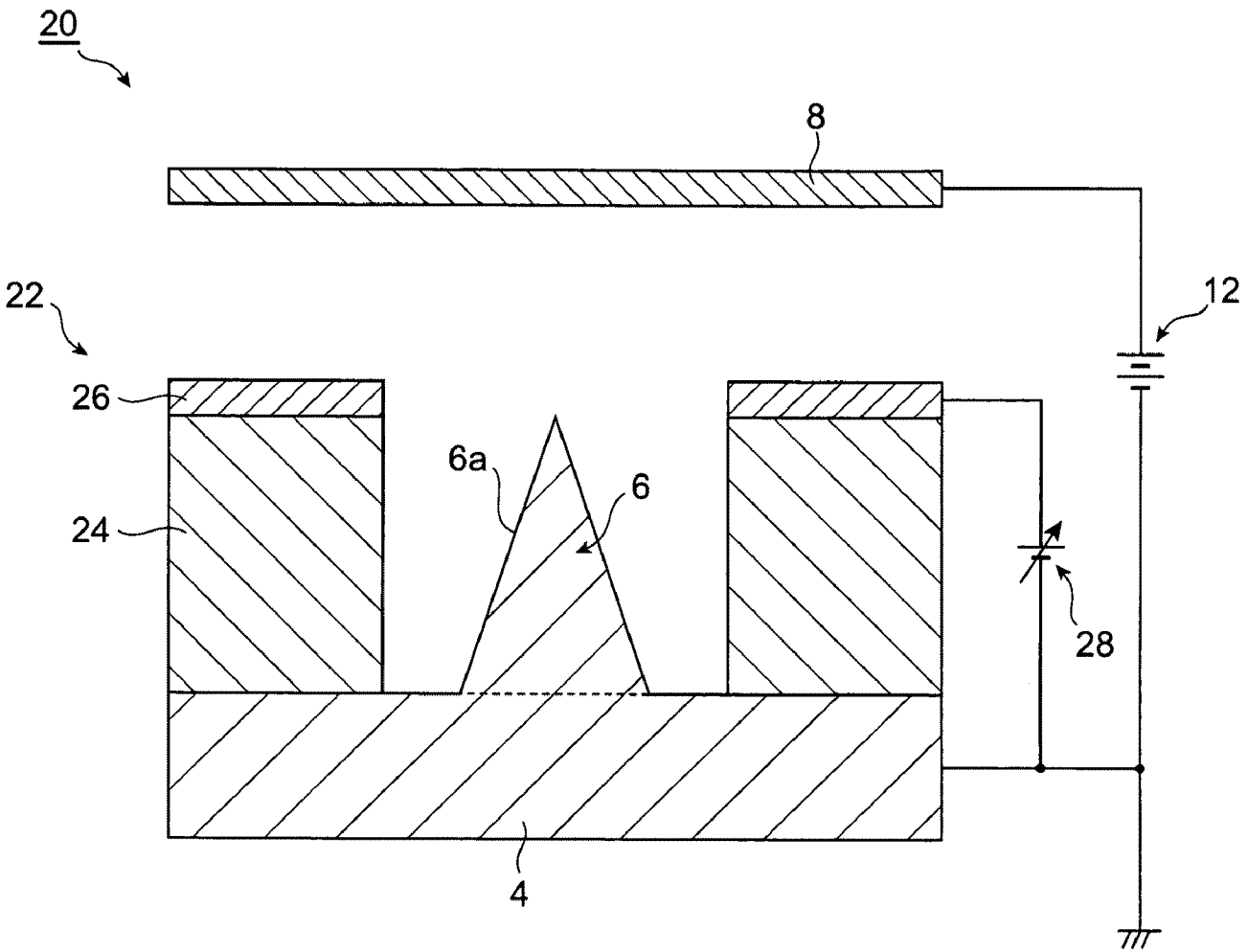
FIG. 3 is a sectional view schematically showing an electron source including an electron emitting device in accordance with the second embodiment.

FIG. 3 is a sectional view schematically showing an electron source equipped with an electron emitting device in accordance with the second embodiment. The electron source 20 shown in FIG. 3 includes an electron emitting device 22. Preferably, the electron source 20 has a Spindt-type cold cathode structure. The electron emitting device 22 has a substrate 4 and an electron emitting portion 6. On the substrate 4, a control electrode (gate electrode) 26 is provided on an insulating layer 24 made of $SiO_2$, for example. Preferably, the control electrode 26 is made of material having a high melting point, such as Mo, Ta, or the like, for example. A variable power supply 28 for applying a voltage to the control electrode 26 is connected between the substrate 4 and control electrode 26.

In this embodiment, the amount of emission of electrons (electron emission current) from the electron emitting device 22 can be adjusted easily and finely with a low voltage by regulating the voltage applied to the control electrode 26 by the variable power supply 28.

The electron emitting device 22 is favorably manufactured by the same method as with the electron emitting device 2. In the manufacturing of the electron emitting device 22, it is preferable that the electron emitting portion be heated in a dry oxygen atmosphere in the oxygen termination step "S1."

Third Embodiment

Figure 4:
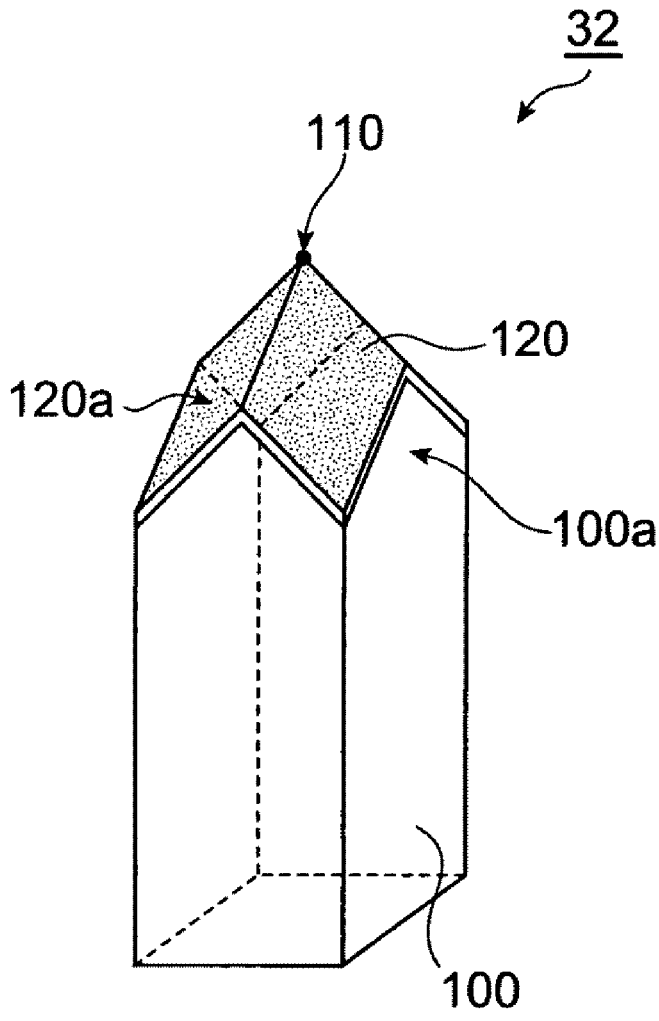
FIG. 4 is a perspective view schematically showing an electron emitting device in accordance with the third embodiment.

FIG. 4 is a perspective view schematically showing an electron emitting device in accordance with the third embodiment. The electron emitting device 32 shown in FIG. 4 comprises a diamond member 100 having a pointed end portion 100*a*, and an electron emitting layer 120 (electron emitting portion) formed on the end portion 100*a* so as to cover the end portion 100*a*. Preferably, the surface 120*a* of the electron emitting layer 120 is oxygen-terminated. Electrons are emitted from the pointed tip 110 of the electron emitting device 32.

The diamond member 100 preferably has a shape like a column with an aspect ratio of one or greater, and the cross section of the member is more preferably rectangular. In the diamond member 100 whose cross-sectional form is rectangular, the maximum length of sides of the rectangle is preferably at least 0.05 mm but not more than 2 mm. This facilitates the mounting thereof to an electron gun chamber of an electron microscope, electron beam exposure apparatus, or the like, for example.

Preferably, plural crystal faces are exposed at the end part 100*a* of the diamond member 100 so as to make the end portion 100*a* sharp-pointed. Preferably, at least one of the crystal faces is (111) face. Examples of methods of forming (111) face are as follows: polishing, laser processing, ion etching, crystal growth, and the combinations thereof.

The diamond member 100 is made of monocrystalline diamond, for example. The diamond member 100 may be made of natural monocrystalline diamond or monocrystalline diamond synthesized by high-pressure high-temperature synthesizing method or vapor phase synthesizing method. It is preferable that the diamond member 100 be made of monocrystalline diamond containing at least $10\times10^{15}$ $cm^{-3}$ of p-type impurity. An example of such monocrystalline diamond is Ib-type monocrystalline diamond containing boron (B) synthesized by high-pressure high-temperature synthesizing method.

Preferably, the electron emitting layer 120 is made of monocrystalline diamond doped with n-type impurity. The electric conductivity characteristic of the electron emitting layer 120 greatly affects the electron emission characteristic. Therefore, in order to reduce fluctuations in the electric conductivity characteristic, it is preferable that the electron emitting layer 120 be epitaxially grown on the end portion 100*a* by a vapor phase synthesizing method. The electron emitting layer 120 may also be formed by a microwave plasma CVD method which can regulate the impurity concentration with a high precision. When the n-type impurity concentration in the electron emitting layer 120 is made high, feeding electrons to a valence band of diamond enables an electron emission in a high current density.

When the electron emission current value is 10 μA or more in the electron emitting device 32, the deviation of the electron emission current value over one hour is within ±20% as in the electron emitting device 2. The number of occurrence of step-like noise that causes stepwise changes of the electron emission current value is once or less per 10 minutes. Therefore, the electron emitting device 32 provides technical contributions and effects similar to those of the electron emitting device 2.

In the manufacturing of the electron emitting device 32, it is preferable that an oxygen termination step, a heating step, and an electron emission step be preformed after forming the electron emitting layer 120.

Having been explained preferred embodiments of the present invention in detail in the foregoing, the present invention is not limited to the above-mentioned embodiments.

EXAMPLES

In the following, the present invention will be explained more specifically with reference to examples, which do not restrict the present invention.

Example 1

A diamond substrate of type IIa monocrystal made by high-pressure high-temperature synthesizing method was prepared, and the diamond substrate has the primary face of (111) plane. Next, using a microwave plasma CVD method, an n-type diamond layer having a thickness of 5 μm was formed on the primary face of the diamond substrate, and the n-type diamond layer was doped with phosphorus. Hydrogen, methane, and phosphine were used as raw material gases. The phosphorus concentration of the n-type diamond layer was $1\times10^{19}$ $cm^{-3}$.

Subsequently, using an ICP-CVD method, an SiON film having a thickness of 200 nm was formed on the n-type diamond layer. Thereafter, using an RIE method, the SiON film was dry-etched with a $CF_4$ gas to form a dot having a diameter of 3 μm. By this dry-etching, a mask layer made of SiON was formed.

Figure 5:
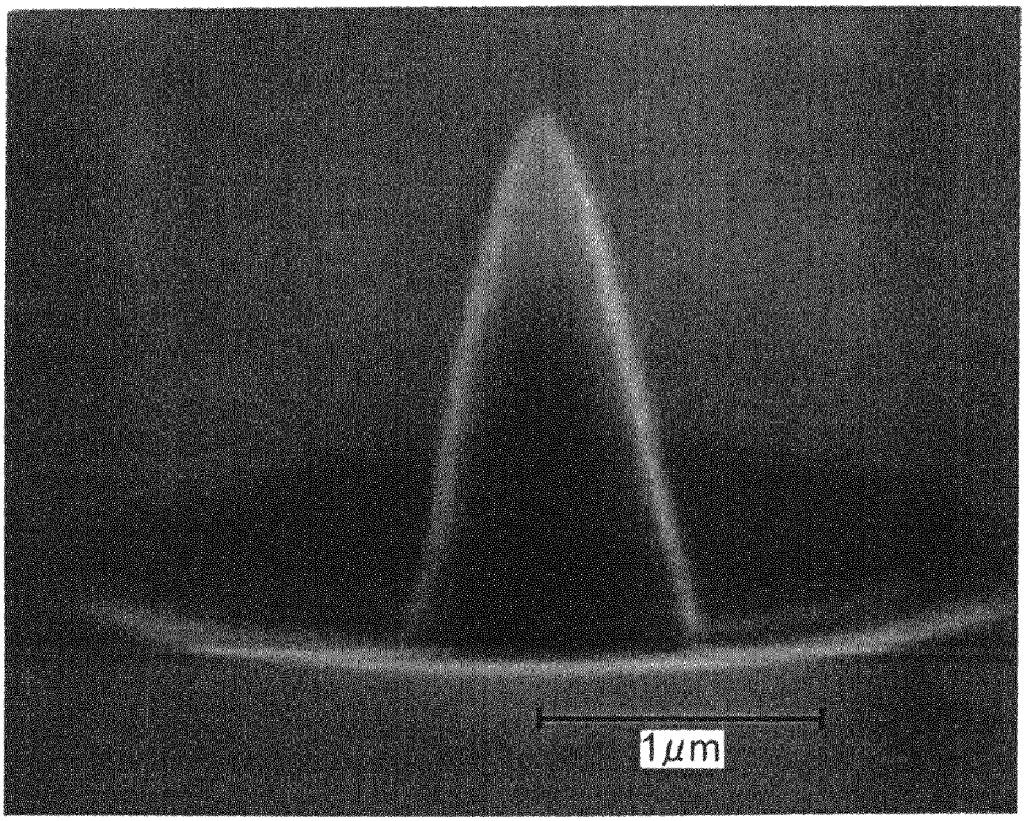
FIG. 5 is a SEM photograph of a projection made of n-type diamond.

Next, using the RIE method, the n-type diamond layer was dry-etched with an oxygen gas and 5% $CF_4$ gas. After the etching, an acid treatment was performed in order to remove etching residues. After the above steps, a projection made of n-type diamond was formed on the diamond substrate. As shown in FIG. 5, the shape of the projection was a cone having a height of 3 μm. FIG. 5 is an SEM photograph showing of the projection made of n-type diamond.

Next, the diamond substrate and the projection were heated for three hours at the temperature of 200° C. in a mixed acid composed of sulfuric acid and nitric acid, (oxygen termination step). Further, the diamond substrate and the projection were heated for one hour at the temperature of 200° C. in a vacuum atmosphere of $1\times10^{-4}$ Pa (heating step). Thus, the electron emitting device in Example 1 was obtained.

Figure 6:
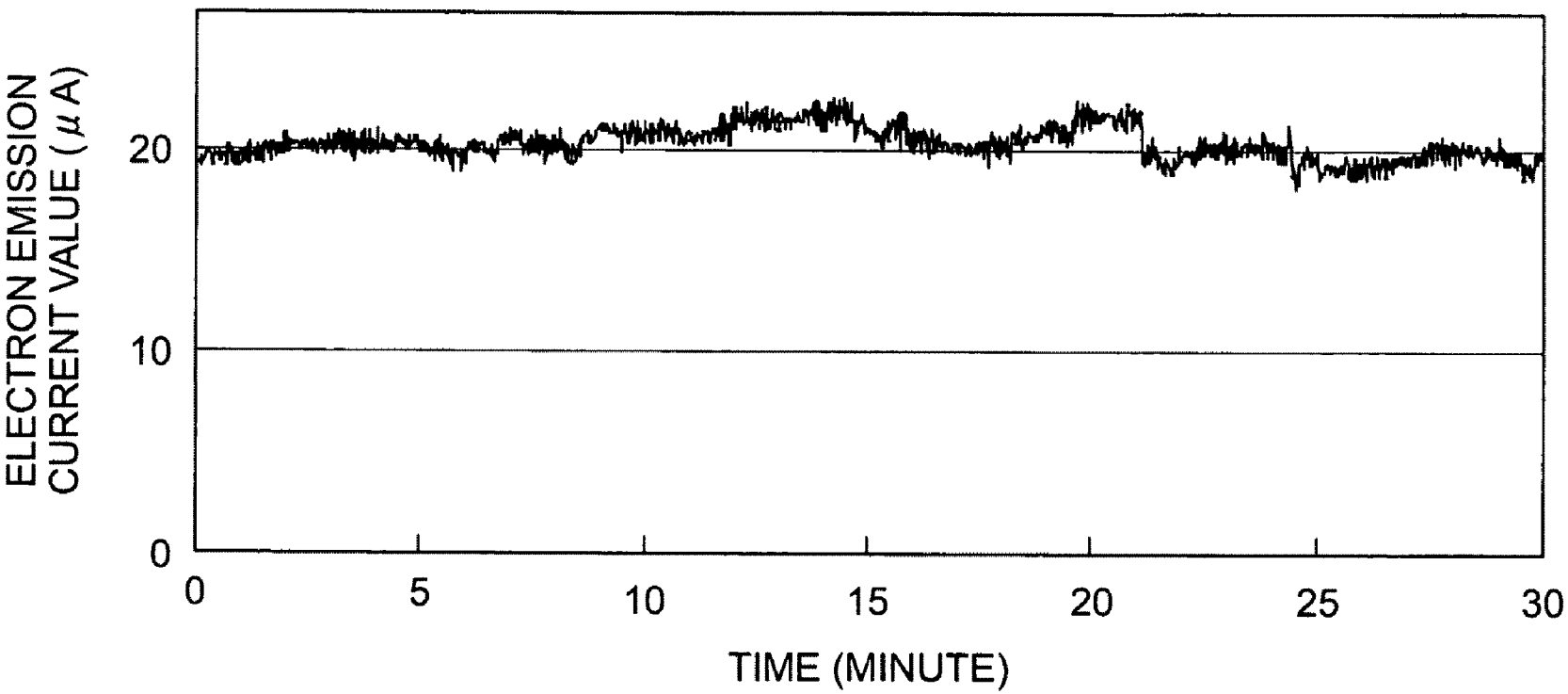
FIG. 6 is a graph showing variation of an electron emission current with time in the electron emitting device in accordance with Example 1.

Subsequently, the operating characteristics of the electron emitting device in accordance with Example 1 were studied. In this measurement, the distance between the tip of the projection and the anode was 100 μm, and the voltage applied between the electron emitting device and anode was 1000 volts. Therefore, an electric field generated between the tip of the projection and the anode is 10 V/μm on an average. FIG. 6 shows results of the measurement of the electron emission current value in the electron emitting device in Example 1.

FIG. 6 is a graph showing variation with time of the electron emission current in the electron emitting device of Example 1. The average value of the electron emission current over one hour was 21 μA. The deviation of the electron emission current value over one hour was ±18%. The number of occurrence of step-like noise was twice in 30 minutes.

Example 2

As in Example 1, a projection made of n-type diamond was formed on a diamond substrate. Next, the diamond substrate and projection were heated for 10 minutes at the temperature of 400° C. in a dry oxygen atmosphere at atmospheric pressure (oxygen termination step). Further, the diamond substrate and the projection were heated for one hour at 400° C. in a vacuum of $1\times10^{-6}$ Pa (heating step). After the above steps, the electron emitting device in Example 2 was obtained.

Figure 7:
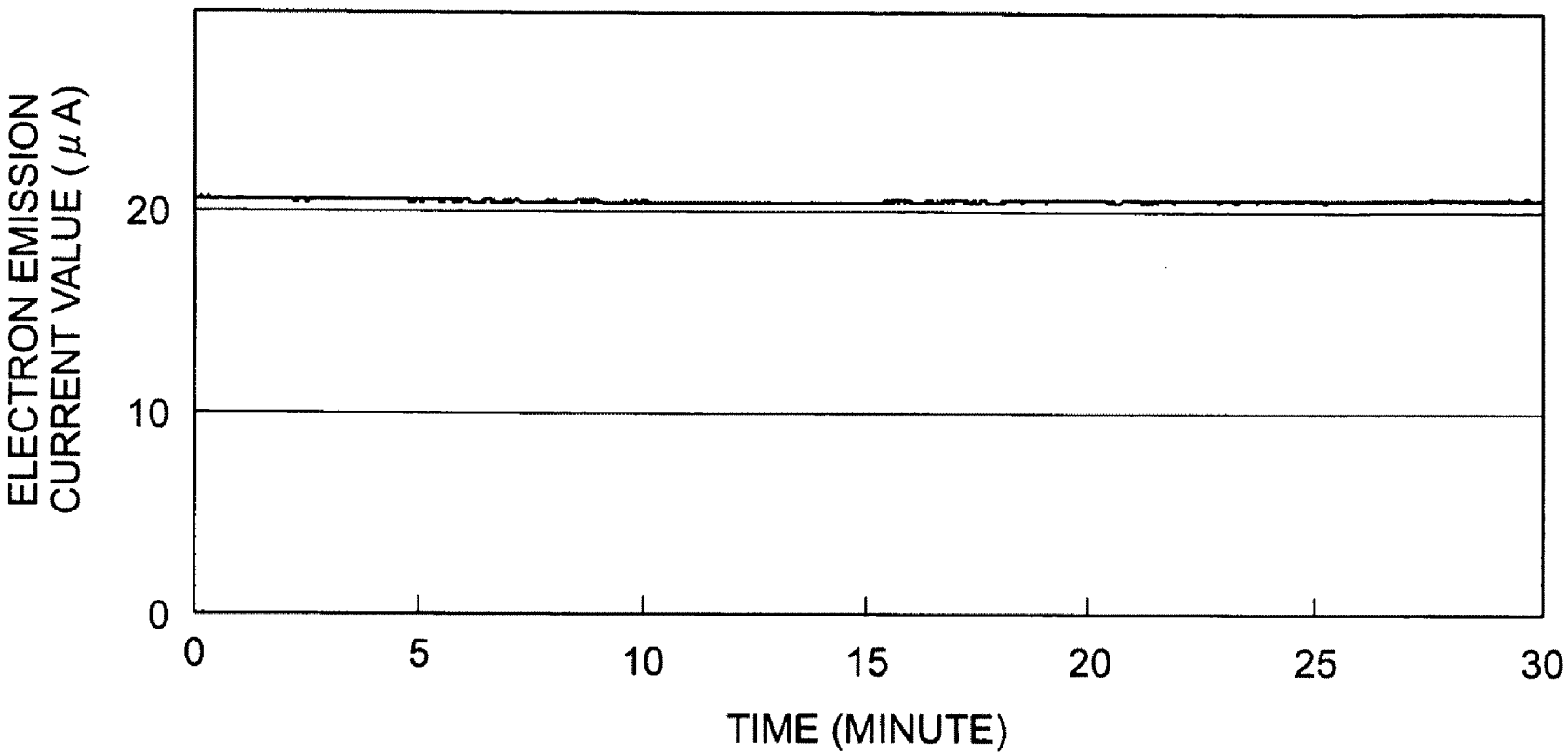
FIG. 7 is a graph showing a variation of an electron emission current with time in the electron emitting device in accordance with Example 2.

Subsequently, the operating characteristics of the electron emitting device in accordance with Example 2 were studied as in Example 1. Referring to FIG. 7, results of the measurement of the electron emission current value in the electron emitting device of Example 2 are shown.

FIG. 7 is a graph showing change with time of the electron emission current value measured in the electron emitting device in Example 2. The average value of the electron emission current was 23 μA. The deviation of electron emission current value over one hour was ±0.91%. The occurrence of step-like noise was not observed in the measurement for one hour.

Further, a number of electron emitting devices in accordance with Example 2 were integrated to make an electron source for a traveling wave tube. The electron emission current value of the electron source including the integrated electron emitting devices was 40 mA, and the stable operation was achieved at the operating frequency of 28 GHz and the saturation power of 11.8 W.

Example 3

An electron emitting device of Example 3 was obtained as in Example 2 except that electrons were emitted for 6 hours while an electric field of 3 V/μm was applied between the tip of the projection and the anode after the heating step such that the average value of electron emission current was 0.1 μA in a vacuum of $1\times10^{-6}$ Pa (electron emission step).

Subsequently, operation characteristics of the electron emitting device in accordance with Example 3 were evaluated as in Example 2. The average value of electron emission current over one hour was 28 μA. The deviation of electron emission current value over one hour was ±0.64%. The number of occurrence of step-like noise was once in 24 hours.

Example 4

An electron emitting device in Example 4 like the electron emitting device 32 shown in FIG. 4 was formed as follows.

First, a rectangular prism form of a Ib-type diamond monocrystal was pointed by polishing to prepare a diamond member 100. The pointed end thereof was prepared to expose a (111) face. The diamond monocrystal contained boron of the concentration of $5\times10^{19}$ $cm^{-3}$. The diamond monocrystal had a transverse cross section of 0.6-mm square and a height of 2.5 mm. Hence, the aspect ratio of the diamond monocrystal was about 4.2.

Next, an n-type diamond layer, which is used as an electron emitting layer 120, having a thickness of 4 μm and containing phosphorus (P) was epitaxially grown so as to cover the pointed end part of the diamond monocrystal. Since the (111) face was exposed at the end part, the phosphorus concentration was high, i.e., about $1\times10^{20}$ $cm^{-3}$. In thus obtained electron emitting device 32, the radius of curvature of the tip 110 was 10 μm.

Next, the electron emitting device 32 was heated for four hours at the temperature of 200° C. in a mixed acid composed of sulfuric acid and nitric acid (oxygen termination step). Further, the electron emitting device 32 was heated for 1.5 hours at the temperature of 200° C. in a vacuum atmosphere of $1\times10^{-4}$ Pa (heating step). The electron emitting device in Example 4 was thus obtained.

Figure 8:
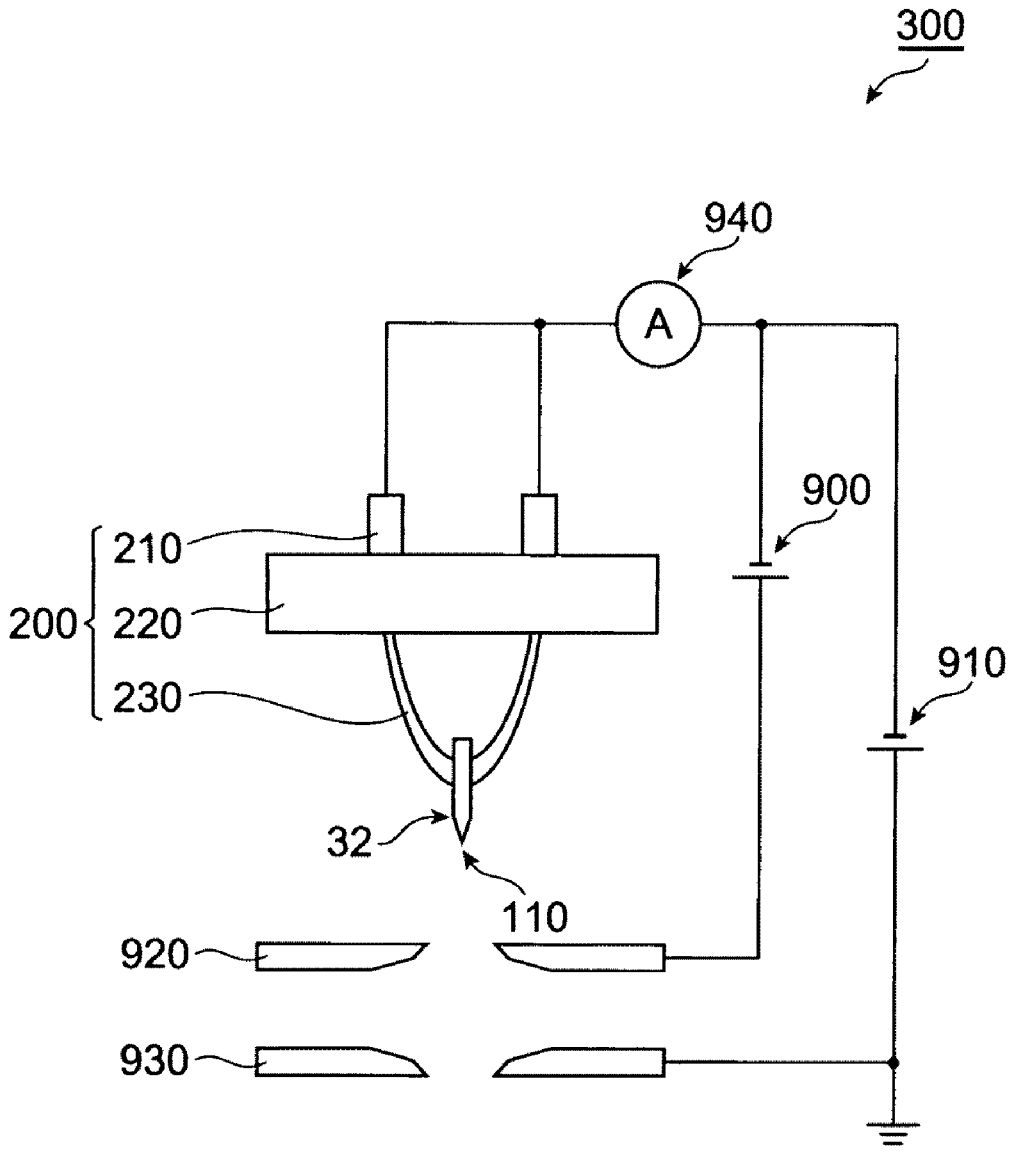
FIG. 8 is a view schematically showing an electron microscope including the electron emitting device in accordance with the third embodiment.

Next, the electron emitting device in Example 4 is mounted in an electron gun chamber of an electron microscope 300 which is shown in FIG. 8. FIG. 8 is a view schematically showing an electron microscope including the electron emitting device in accordance with the third embodiment. As shown in FIG. 8, the electron emitting device 32 is held by a holding member 230 attached to an insulating member 220. Terminals 210 are attached to the insulating member 220. The terminals 210 are attached to the electron gun chamber. Power is applied to the terminals 210 and is supplied to the electron emitting device 32 through the holding member 230.

The electron microscope 300 comprises a lead electrode 920 and an acceleration electrode 930 which is opposed to the tip 110 of the electron emitting device 32. A lead power supply 900 is connected between the lead electrode 920 and the terminals 210. An acceleration power supply 910 is connected between the acceleration electrode 930 and the terminals 210. An emission ammeter 940 is placed between the terminals 210 and the lead power supply 900 and acceleration power supply 910.

Subsequently, pressure in the electron gun chamber was set at $1\times10^{-7}$ Pa, and the electron emitting device of Example 4 was heated for two hours at temperature of 450° C. while feeding current to the electron emitting device of Example 4, thereby causing emission of electrons for two hours (electron emission step). Here, the respective voltages applied to the lead electrode 920 and acceleration electrode 930 were adjusted such that the average of electron emission current value provided by the emission ammeter 940 was about 1 μA.

Subsequently, with voltages of 5 kV and 30 kV applied to the lead electrode 920 and acceleration electrode 930, respectively, change with time of the electron emission current value indicated by the emission ammeter 940 were measured. Thus, operating characteristics of the electron emitting device in accordance with Example 4 were evaluated. The average value of electron emission current over one hour was about 90 μA. The deviation of the electron emission current value over one hour was ±0.12%. The occurrence of step-like noise was not observed in one hour.

Example 5

An electron emitting device in Example 5 was formed as in Example 2 except that no heating step was performed.

Subsequently, operating characteristics of the electron emitting device in accordance with Example 5 were evaluated as in Example 2. The average value of electron emission current over one hour was 12 μA. The deviation of the electron emission current value over one hour was ±19%. The number of occurrence of step-like noise was twice in 20 minutes.

Example 6

An electron emitting device of Example 6 was obtained as in Example 5 except that the diamond substrate and projection were heated for 2.5 hours at the temperature of 250° C. in a mixed acid composed of sulfuric acid and nitric acid in the oxygen termination step.

Subsequently, operating characteristics of the electron emitting device in accordance with Example 6 were evaluated as in Example 2. The average value of electron emission current over one hour was 14 μA. The deviation of the electron emission current value over one hour was ±18%. The number of occurrence of step-like noise was five times in one hour.

Comparative Example 1

An electron emitting device of Comparative Example 1 was obtained as in Example 1 except that the oxygen termination step and heating step were not performed.

Subsequently, operating characteristics of the electron emitting device in accordance with Comparative Example 1 were evaluated as in Example 1. The average value of electron emission current over one hour was 3.1 μA. The deviation of the electron emission current value over one hour was ±82%. The number of occurrence of step-like noise was eight times in one hour.

The invention claimed is:

1. An electron emitting device comprising:

an electron emitting portion made of diamond, wherein:

a surface of the electron emitting portion is oxygen-terminated, an oxygen coverage ratio of the surface of the electron emitting portion is at least 5%, the electron emitting portion is made of n-type diamond, and the electron emitting device has properties such that a deviation over one hour of an electron emission current is within ±20% at an electron emission current value of 10 μA or more, the electron emission current is changed stepwise in step-like noise, and the number of occurrence of the step-like noise is one or less per 10 minutes.

2. The electron emitting device according to claim 1, wherein the surface of the electron emitting portion is oxygen-terminated by at least one of the following processes (i) and (ii):

(i) the surface of the electron emitting portion is dry-oxygen-terminated by heating the electron emitting portion in an oxygen atmosphere, and (ii) the surface of the electron emitting portion is heated in a liquid containing at least one of sulfuric acid and nitric acid.

3. An electron emitting device comprising:

an electron emitting portion made of diamond, wherein:

a surface of the electron emitting portion is oxygen-terminated, an oxygen coverage ratio of the surface of the electron emitting portion is at least 5%, the electron emitting portion is made of n-type diamond, surface absorption molecules are desorbed, the surface of the electron emitting portion is formed by an oxygen-termination process and a heating process, and the electron emitting device has properties such that a deviation over one hour of an electron emission current is within ±1% at an electron emission current value of 10 μA or more, the electron emission current is changed stepwise in step-like noise, and the number of occurrence of the step-like noise is one or less per one hour.

4. The electron emitting device according to claim 3, wherein the surface of the electron emitting portion is oxygen-terminated by at least one of the following processes (i) and (ii):

(i) the surface of the electron emitting portion is dry-oxygen-terminated by heating the electron emitting portion in an oxygen atmosphere, and (ii) the surface of the electron emitting portion is heated in a liquid containing at least one of sulfuric acid and nitric acid.

5. An electron emitting device comprising:

an electron emitting portion made of diamond, wherein:

the diamond is n-type diamond, a surface of the electron emitting portion being oxygen-terminated, an oxygen coverage ratio of the surface of the electron emitting portion is at least 5%, and the surface of the electron emitting portion is oxygen-terminated by at least one of the following processes (i) and (ii):

(i) the surface of the electron emitting portion is dry-oxygen-terminated by heating the electron emitting portion in an oxygen atmosphere, and (ii) the surface of the electron emitting portion is heated in a liquid containing at least one of sulfuric acid and nitric acid.

6. The electron emitting device according to claim 3, wherein the surface of the electron emitting portion is provided by a heating process in which the surface of the electron emitting portion is heated for one hour or more at a temperature of 400° C. or less in a vacuum atmosphere of $1\times10^{-6}$ Pa or less.

* * * * *